US005407011A

United States Patent [19]

Layton

[11] Patent Number: 5,407,011

[45] Date of Patent: Apr. 18, 1995

[54] DOWNHOLE MILL AND METHOD FOR MILLING

[75] Inventor: Darin Layton, Lubbock, Tex.

[73] Assignee: Wada Ventures, Hobbs, N. Mex.

[21] Appl. No.: 132,963

[22] Filed: Oct. 7, 1993

[51] Int. Cl.[6] ..... E21B 29/00

[52] U.S. Cl. ..... 166/376; 175/325.3; 175/326

[58] Field of Search ..... 166/55.3, 376; 175/325.1, 325.3, 326

[56] References Cited

U.S. PATENT DOCUMENTS

| | | | |
|---|---|---|---|
| 1,877,395 | 9/1932 | Goeser | 175/325.3 |
| 1,890,530 | 12/1932 | Santiago | 175/325.3 |
| 1,913,365 | 6/1933 | Bailey | 175/325.3 |
| 2,167,194 | 7/1939 | Anderson | 175/325.3 X |
| 3,413,045 | 11/1968 | Wohlfeld | 175/325.3 |

*Primary Examiner*—Ramon S. Britts
*Assistant Examiner*—Frank S. Tsay
*Attorney, Agent, or Firm*—Burns, Doane, Swecker & Mathis

[57] ABSTRACT

A mill assembly having a mill face for milling material in a downhole milling operation is received in a casing or well bore having an internal wall having a first diameter. The mill face has a smaller diameter than the first diameter. The mill face is connected to a shaft assembly including a shaft and a stabilizing assembly for stabilizing the shaft in the casing or the well bore. The stabilizing assembly is connected at one end to the mill face and has a smaller diameter than the first diameter. The stabilizing assembly includes a stem having one or more tapered surfaces, the tapered surfaces tapering from a first diameter to a second diameter larger than the first diameter. The stabilizing assembly further includes a plurality of roller bearings circumferentially arranged in a plane around the stem, each roller bearing being in contact with one of the tapered surfaces at a first point. One of the roller bearings and the stem are moved so that each of the plurality of roller bearings contacts the tapered surface at a second point closer to the second diameter than the first point and is thereby brought into contact with the internal wall of the casing to stabilize the shaft. A method of milling is also described.

31 Claims, 3 Drawing Sheets

DOWNHOLE MILL AND METHOD FOR MILLING

BACKGROUND AND SUMMARY OF THE INVENTION

The present invention relates to apparatus and methods for milling and, more particularly, to apparatus and methods for milling materials stuck in down-hole operations.

In milling apparatuses- for milling material such as metal stuck in casings or drilled bores in down-hole operations, e.g., in well bores, a mill including a mill face, referred to herein as "mill face" for convenience, is disposed at the bottom end of a shaft and turned to mill the stuck material. As in, for example, earth boring operations, pressurized water may be circulated to the bottom of the mill face to facilitate milling of the material being milled, to keep the temperature of the mill face down, and to carry away the milled particles.

It is often desirable to mill material having a larger diameter than the maximum outside diameter of the mill face able to be provided in the bore or casing. One technique for milling under such circumstances is to offset the centerline of the usually circular mill face from the centerline of the usually circular shaft. In U.S. Pat. Nos. 712,887 to Wyczynski and 4,183,415 to Stenuick, for example, variations on the general theme of drilling holes with offset or eccentric drilling devices are shown.

When the mill face is turned in the material being milled, it is desirable to stabilize the shaft relative to the casing or bore wall to ensure that the mill face contacts the surface being milled at the proper location relative to the centerline of the casing. This is particularly so in offset milling operations where it is generally necessary to use a mill face and a shaft connected to the mill face having smaller outside diameters than the inside diameter of the casing or bore. Known stabilizing assemblies tend to be permanently fixed on an exterior surface of the shaft between the shaft and the inner casing or bore wall. Such stabilizing assemblies can render movement of the mill face and the stabilizing assembly within the casing or bore difficult. Accordingly, it is desirable to provide an offset milling device including a stabilizing assembly that is easy to maneuver in the casing or bore.

In accordance with one aspect of the present invention, a mill assembly for downhole milling in a bore includes a mill face and means for extending the mill face into a bore. Means for stabilizing the extending means in the bore are provided and include a cam and a cam follower in contact with the cam. One of the cam and the cam follower are axially movable so that the cam follower is moved radially outward from a centerline of the stabilizing means.

In accordance with another aspect of the present invention, a mill assembly for downhole milling in a bore includes a mill face and a shaft for extending the mill face into a bore and into contact with a material to be milled. Means, connected at one end to the mill face and having a smaller diameter than the first diameter, are provided for stabilizing the shaft in the bore, and include a stem having one or more tapered surfaces, the tapered surfaces tapering from a first diameter to a second diameter larger than the first diameter, a plurality of roller bearings circumferentially retained in a plane around the stem, each roller bearing being in contact with one of the tapered surfaces at a first point.

One of the roller bearings and the stem are axially movable such that each of the plurality of roller bearings contacts the tapered surface at a second point closer to the second diameter than the first point and is thereby moved axially outward from a centerline of the stem.

In accordance with yet another aspect of the present invention, a method of milling a material in a longitudinal opening having an inside diameter defined by an internal wall, with a mill face at the end of a shaft is disclosed. In the method the mill face at the end of the shaft is extended into the longitudinal opening and into contact with the material to be milled. The shaft is stabilized relative to the internal wall of the longitudinal opening by axially moving one of a cam and a cam follower, the cam and the cam follower forming a part of the shaft, relative to one another so that the cam follower is moved radially outward from a centerline of the shaft and toward the internal wall of the longitudinal opening.

BRIEF DESCRIPTION OF THE DRAWINGS

The objects and advantages of the invention will become apparent from the following detailed description of a preferred embodiment thereof in connection with the accompanying drawings in which like numerals designate like elements and in which.

DESCRIPTION OF THE PREFERRED EMBODIMENT

Figure 1:
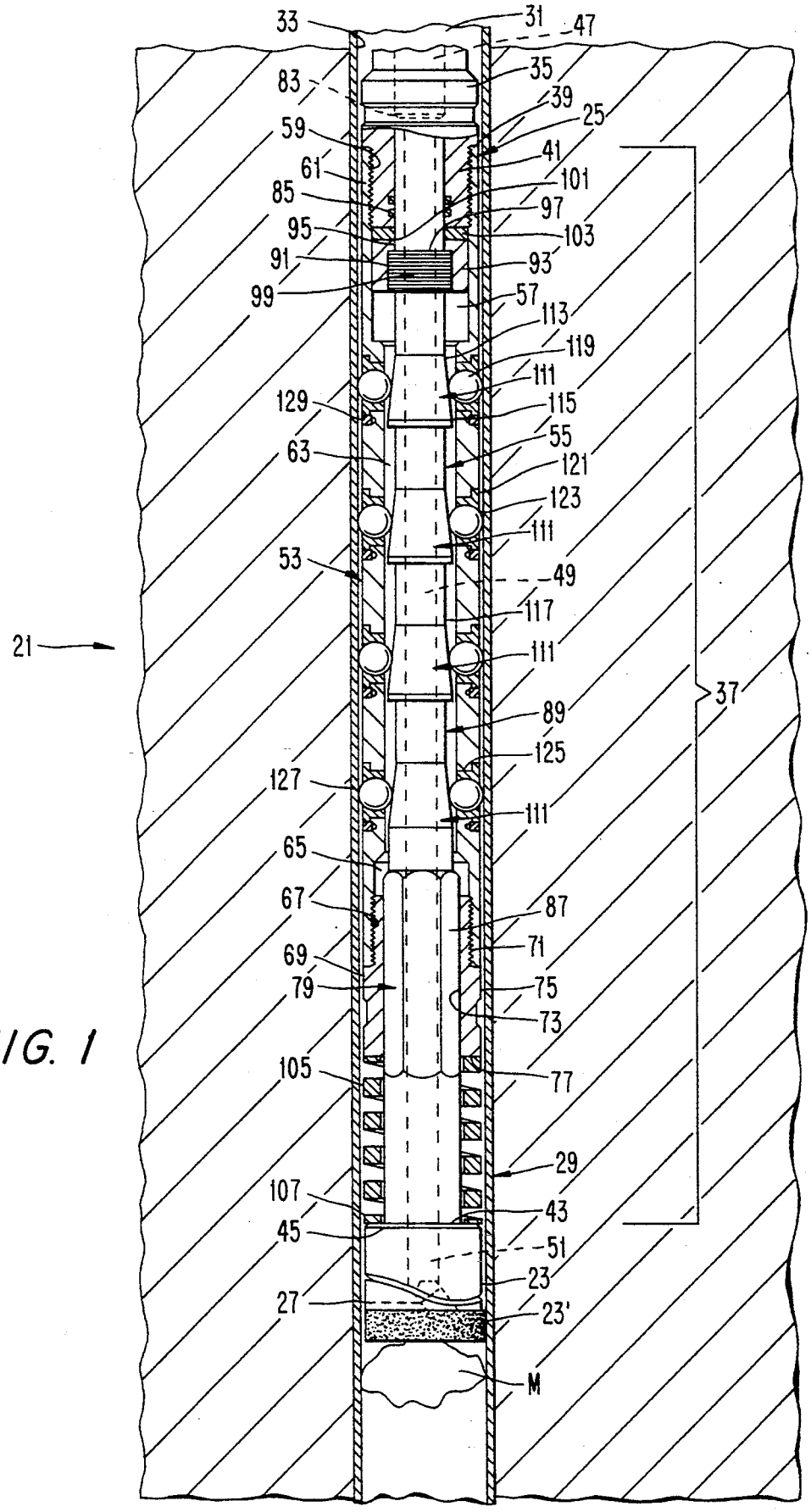
FIG. 1 is a side, partially cross-sectional view of a mill, disposed in a casing, according to a first embodiment of the invention.
Figure 2:
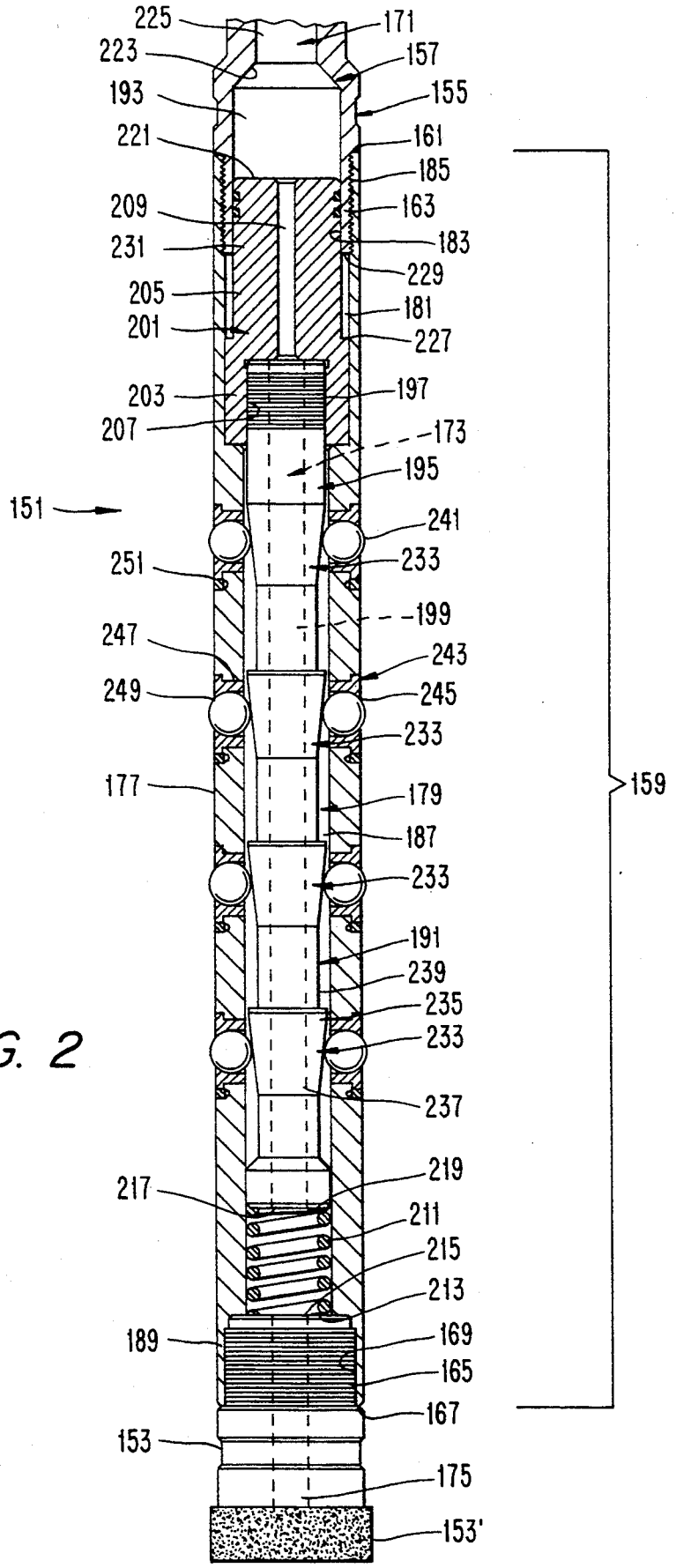
FIG. 2 is a side, partially cross-sectional view of a mill according to a second embodiment of the invention.

A side, partially cross-sectional view of a mill assembly 21 according to a first embodiment of the invention is seen in FIG. 1, and a side, partially cross-sectional view of a mill assembly 151 according to a second embodiment of the invention is seen in FIG. 2. With reference to FIG. 1, the mill assembly 21 includes a mill face 23 that is extended, at the end of a shaft assembly 25, into a casing 29 and into contact with the material M being milled. While the embodiment of the mill assembly 21 shown in FIG. 1 is shown as being received in a longitudinal opening 31 in the casing 29, it is understood that the casing may be entirely omitted, if desired, and the mill assembly may be received in an uncased drilled bore (not shown). A substantial portion of the shaft assembly 25 in the cased or uncased bore in which material is being milled is disposed within the longitudinal opening 31 in the substantially circular casing 29 or a longitudinal opening in the substantially circular uncased bore, the longitudinal opening having an interior diameter defined by the internal wall 33 of the casing.

The mill face 23 includes an abrasive portion 23' that contacts the material being milled. The mill face 23 of the mill assembly 21 is forced down against and turned in the material being milled by any one of numerous known force applying apparatus. The force applying apparatus is generally located outside of the cased or uncased bore. The force applying apparatus is preferably capable of both applying a force in the downward direction between 4000 to 5000 pounds, and of transmitting a torque to the mill face through the shaft assembly 25.

Figure 3:
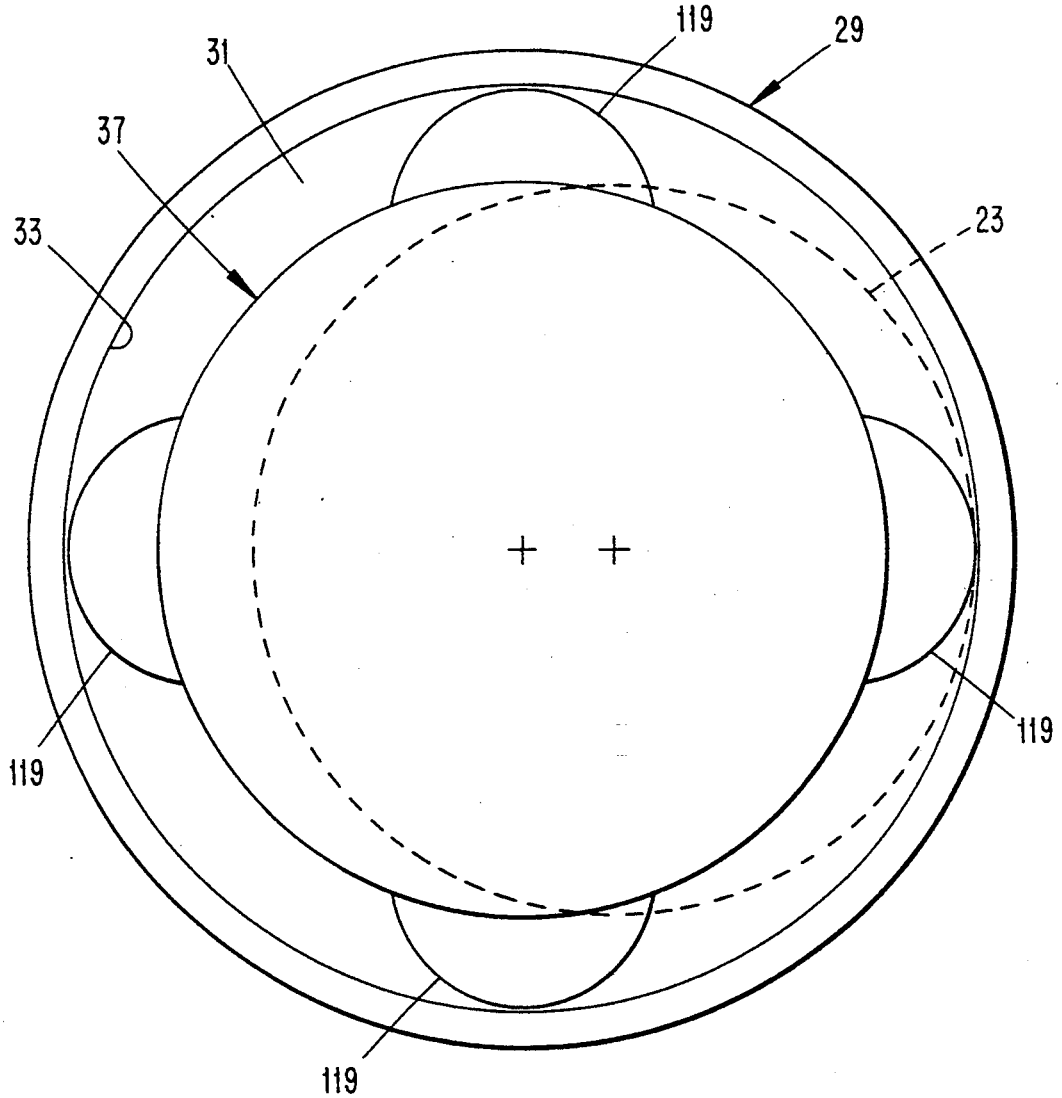
FIG. 3 is a schematic, bottom view of a portion of an offset mill in a casing.

As seen in FIG. 3, a centerline of the mill face 23 may be offset from a centerline of the shaft assembly 25 to form an offset mill assembly that is capable of milling material larger than the outside diameter of the mill face. In the embodiment shown in FIG. 3, the mill face 23 is adapted to mill material substantially equal in size to the inside diameter of the casing 29.

The shaft assembly 25 includes a known shaft 35 and means 37 for stabilizing the shaft assembly in the longitudinal opening 31 of the casing 29, the top end 39 of the stabilizing means being attached to the shaft at the bottom end 41 of the shaft. A top end 43 of the mill face 23 is attached to a bottom end 45 of the stabilizing means 37. The shaft 35, the stabilizing means 37, and the mill face 23 are preferably provided with a shaft passage 47, a stabilizing means passage 49, and a mill face passage 51, respectively. The shaft passage 47, the stabilizing means passage 49, and the mill face passage 51 are all in fluid communication so that pressurized fluid can be forced through the shaft 35, the stabilizing means 37, and the mill face 23 to facilitate milling of the material being milled, cooling of the mill face, and flushing away of milled material.

The stabilizing means 37 includes a sleeve 53 formed with a longitudinal passage 55. An upper portion 57 of the passage 55 has a first diameter and includes an internally threaded portion 59. The internally threaded portion 59 is fixed to the bottom end 41 of the shaft 35 by being screwed onto an externally threaded portion 61 of the shaft. A central portion 63 of the passage 55 of the sleeve 53 preferably has a second diameter that is less than the first diameter of the upper portion 57. A lower portion 65 of the passage 55 of the sleeve 53 preferably has a third diameter that is greater than the second diameter of the central portion 63.

The lower portion 65 includes an internally threaded portion 67 for fixing a mandrel body 69 of the stabilizing means 37 thereto, the mandrel body 69 having an externally threaded top portion 71 and a non-circular central passage 73 to the sleeve 53. The non-circular central passage 73 of the mandrel body 69 is axially aligned with the passage 55 of the sleeve 53. The mandrel body 69 has a lower portion 75 including a bearing surface 77.

The stabilizing means 37 further includes a mandrel 79 that is axially movable in the shaft passage 47, the passage 55 in the sleeve 53, and the non-circular central passage 73 of the mandrel body 69. The mill face 23 is attached to the bottom end of the mandrel 79, the bottom end of the mandrel defining the bottom end 45 of the stabilizing means 37. The mandrel 79 includes a top portion 83 that fits in and is axially movable relative to the shaft passage 47. The stabilizing means passage 49 extends through the mandrel 79 and fluid from the shaft passage 47 flows into the stabilizing means passage when the top portion 83 of the mandrel is in the shaft passage. Sealing means 85 such as ring seals is preferably provided in one or more recesses formed in the top portion 83 of the mandrel 79 or, preferably, in the shaft passage 47.

The mandrel 79 further includes a non-circular bottom portion 87 that is axially movable, but not rotationally movable, relative to the non-circular central passage 73 of the mandrel body 69. The bottom portion 87 of the mandrel 79 and the non-circular central passage 73 of the mandrel body 69 are preferably both hexagonal in shape. A stem portion 89 extends between the bottom portion 87 and the top portion 83, the stem portion being primarily disposed in and axially movable relative to the passage 55 in the sleeve 53. The stem portion 89 of the mandrel 79 is formed with an externally threaded portion 91 below the top portion 83.

A stem nut 93 for retaining the mandrel 79 in connection with the sleeve 53 is screwed over the externally threaded portion 91 of the stem portion 89 of the mandrel to a point limited by a flange 95 at a top end 97 of an internally threaded opening 99 of the stem nut. The stem nut 93 is sized so that it is axially movable in the upper portion 57 of the passage 55 of the sleeve 53 between a point defined by the beginning of the central portion 63 of the passage and a bottom face 101 of the shaft 35.

A spring 105 is disposed around the bottom portion 87 of the mandrel 79 between the bearing surface 77 at the lower portion 75 of the mandrel body 69 and a bearing surface 107 at the top end 43 of the mill face 23. When the force applying apparatus applies a downward force on the shaft 35, the shaft, the sleeve 53, and the mandrel body 69 move downward relative to the mandrel 79 and the mill face 23 to compress the spring 105. The top end 97 of the stem nut 93 contacts the bottom face 101 of the shaft 35 or the spacer 103 to limit the downward movement of the shaft, the sleeve 53, and the mandrel body 69 relative to the mandrel 79 and the mill face 23 and, in this manner, the downward force from the force applying means is transmitted to the mill face.

The stem 89 includes one or more, preferably four axially aligned cam surfaces 111. The cam surfaces 111 are preferably in the form of truncated cones having upper portions 113 of smaller diameter than lower portions 115. The cam surfaces 111 are preferably separated from one another by a desired distance with cylindrical portions 117 of the stem 89 so that the stabilizing means provides support to the shaft assembly 25 over a sufficient length of the shaft assembly. A spacer 103 is preferably disposed at the bottom face 101 of the shaft 35 or at the top end 97 of the stem nut 93 to permit adjustment of the initial position of the cam surfaces 111 relative to the sleeve 53, the spacer preferably being formed of a suitable steel material.

Cam followers, preferably in the form of roller bearings 119 retained in seats 121 screwed into the sleeve 53, are mounted circumferentially around the sleeve. The seats 121 have openings 123 that permit a portion of the roller bearings 119 to extend past the periphery of the sleeve 53. The seats 121 are preferably provided with external threads 125 for screwing the seats into internally threaded bores 127 in the sleeve 53. The seats 121 are preferably further fastened to the sleeve 53 with set screws 129.

The roller bearings 119 contact the cam surfaces 111. When the spring 105 is not compressed, the roller bearings 119 contact the cam surfaces 111 at points near the narrow upper portions 113 of the cam surfaces. As the sleeve 53 is moved downward relative to the mandrel 79, the roller bearings 119 move with the sleeve so that the roller bearings contact the cam surfaces 111 at points near the thicker lower portions 115 of the cam surfaces. As the roller bearings 119 move along the cam surfaces 111 from the narrow upper portions 113 of the cam surfaces to the thicker lower portions 115 of the cam surfaces, the roller bearings are moved radially away from a centerline of the stabilizing means 37 and toward the internal wall 33 of the casing 29 or an internal wall of an uncased bore so that the roller bearings extend past the periphery of the sleeve and contact the internal wall of the casing or the bore to stabilize the mill assembly 21 relative to the internal wall.

When the force compressing the spring 105 is released, as when it is desired to withdraw the mill assembly 21 from the casing 29 or uncased bore, the spring expands to move the mandrel body 69, the sleeve 53 and the roller bearings 119, and the shaft 35 upward relative to the mill face 23 and the mandrel 79. The roller bearings 119 are no longer pushed radially outward by the thicker lower portions 115 of the cam surfaces 111 and can freely move between radially outermost positions in the seats 121 and radially innermost positions in contact with the narrow upper portions 113 of the cam surfaces. In this manner, it is possible to withdraw the stabilizing means 37 from the casing 29 or the uncased bore without interference between outwardly forced roller bearings 119 of the stabilizing means 37 and the internal wall 33 of the casing or the uncased bore.

When a torque is applied to the shaft 35 in a known manner, it is transmitted to the sleeve 53 attached to bottom end 41 of the shaft. The sleeve 53, in turn, transmits the torque to the mandrel body 69 attached to the sleeve. The mandrel body 69, in turn, transmits torque to the mandrel 79, the non-circular bottom portion 87 of which is in the non-circular central passage 73 of the mandrel body.

While the mill assembly 21 has been described in connection with a preferred embodiment in which the cam followers are roller bearings 119 retained in seats 121 mounted on the sleeve 53, it is understood that other types of cam follower arrangements may be used. For example, the cam follower might be in the form of an L-shaped link (not shown) that is pivotally mounted to the sleeve so that one end of the link contacts the cam surface 111 and the other end of the link is adapted to be moved radially outward past the periphery of the sleeve and into contact with the internal wall 33 of the casing 29 or the uncased bore. Cam followers in the form of roller bearings 119 are preferred, however, at least because they tend to rotate during rotation of the shaft assembly 25 and the mill face 23, thereby reducing frictional effects between the cam follower and the internal wall 33 of the casing 29 or the uncased bore.

Preferably, groups of four roller bearings 119 are arranged circumferentially around the sleeve 53 in a common plane. Each group of four roller bearings are preferably radially offset from an upper or lower group of four roller bearings by 45° although, for purposes of clarity, this is not shown in the drawings. If desired for particular applications, coplanar groups of roller bearings 119 may include more or fewer than four roller bearings, and the groups of roller bearings may be offset from upper and lower ones of groups of roller bearings by more or less than 45°, or not offset at all.

A side, partially cross-sectional view of a mill assembly 151 according to a second embodiment of the invention is seen in FIG. 2. The mill assembly 151 includes a mill face 153 that is extended, at the end of a shaft assembly 155, into the casing or uncased bore so that an abrasive surface 153' of the mill face is placed against the material being milled.

The shaft assembly 155 includes a known shaft 157 and means 159 for stabilizing the shaft assembly in the longitudinal opening of the casing (not shown for purposes of clarity) or in the bore, the top end 161 of the stabilizing means being attached to the shaft at the bottom end 163 of the shaft. A top threaded end 165 of the mill face 153 is fixed to the bottom end 167 of the stabilizing means 159 by being screwed into an internal threaded portion 169 at the bottom end of the stabilizing means.

The shaft 157, the stabilizing means 159, and the mill face 153 are preferably provided with a shaft passage 171, a stabilizing means passage 173, and a mill face passage 175, respectively. The shaft passage 171, the stabilizing means passage 173, and the mill face passage 175 are all in fluid communication so that pressurized fluid can be forced through the shaft 157, the stabilizing means 159, and the mill face 153 to facilitate milling of the material being milled, cooling of the mill face, and flushing away of milled material.

The stabilizing means 159 includes a sleeve 177 formed with a longitudinal passage 179. An upper portion 181 of the passage 179 has a first diameter and includes an internally threaded portion 183. The internally threaded portion 183 is fixed to the bottom end 163 of the shaft 157 by being screwed onto an externally threaded portion 185 of the shaft. A central portion 187 of the passage 179 of the sleeve 177 has a smaller diameter than the upper portion 181 and extends to the internally threaded portion 169. The internally threaded portion 169 is formed in a lower portion 189 of the sleeve 177 and preferably has a larger diameter than the central portion 187.

A stem assembly 191 is axially movable in an enlarged bottom portion 193 of the shaft passage 171 and the upper and central portions 181 and 187 of the passage 179 in the sleeve 177. The stem assembly 191 includes a stem 195 having an externally threaded top end 197 and an axial passage 199 defining a portion of the stabilizing means passage 173. The stem assembly 191 further includes a piston 201 having a bottom portion 203 and a top portion 205 with a smaller outside diameter than the bottom portion of the piston. An internally threaded bore 207 is formed in the bottom portion 203 of the piston 201 for fixing the externally threaded top end 197 of the stem 195 to the piston. The piston 201 is formed with a choke or axial passage 209 that, with the axial passage 199 of the stem 196, defines a portion of the stabilizing means passage 173.

A spring 211 is disposed in the central portion 187 of the passage 179 in the sleeve 177, a bottom end 213 of the spring being in contact with a bearing surface 215 at the top end 165 of the mill face 153. A bottom end 217 of the stem 195 contacts a top end 219 of the spring 211. When the spring 211 is not compressed, it maintains the stem 195 in a first position in which a top face 221 of the piston 201 is at or near a transition portion 223 of the shaft passage 171 between the enlarged bottom portion 193 of the shaft passage and a narrower upper portion 225 of the shaft passage. Further, a circumferential bearing surface 227 on the piston 201 between the larger bottom portion 203 of the piston and the smaller top portion 205 is urged to contact a bottom face 229 of the shaft 157, thereby limiting the possible upward position of the stem relative to the sleeve 177 and the shaft 157. A spacer 231 is preferably provided between the bottom face 229 of the shaft 157 and the circumferential bearing surface 227 of the piston 201.

When pressurized fluid flows through the shaft passage 171, it applies a force against the top face 221 of the piston 201. The force against the top face 221 of the piston 201 causes the stem assembly 191 to move downward relative to the shaft 157 and the sleeve 177 and compress the spring 211. The force against the piston 201 resulting from the flow of pressurized fluid is at least in part determined by the diameter of the choke or axial passage 209 in the piston. Accordingly, depending upon the available pressure of the pressurized fluid, the spring constant of the spring 211 or the diameter of the choke or axial passage 209 of the piston 201 can be varied to ensure that the spring will be sufficiently compressed by the pressure against the piston.

The operation of the stabilizing means 159 of the mill assembly 151 is similar to the operation of the stabilizing means 37 of the mill assembly 21. The stem 195 includes one or more, preferably four axially aligned cam surfaces 233. The cam surfaces 233 are preferably in the form of truncated cones having upper portions 235 of larger diameter than lower portions 237. The cam surfaces 233 are preferably separated from one another by a desired distance with cylindrical portions 239 of the stem 195 so that the stabilizing means is able to stabilize the shaft assembly 155 over a sufficient length of the shaft assembly.

Cam followers, preferably in the form of roller bearings 241 retained in seats 243 screwed into the sleeve 177, are mounted circumferentially around the sleeve. The seats 243 have openings 245 that permit a portion of the roller bearings 241 to extend past the periphery of the sleeve 177. The seats 243 are preferably provided with external threads 247 for screwing the seats into internally threaded bores 249 in the sleeve 177. The seats 243 are preferably further fastened to the sleeve 177 with set screws 251.

The roller bearings 241 contact the cam surfaces 233. When no or little pressurized fluid is supplied through the shaft passage 171, the spring 211 is not compressed and the roller bearings 241 contact the cam surfaces 233 at points near the narrow lower portions 237 of the cam surfaces. When sufficient pressurized fluid is supplied to compress the spring 211, the stem assembly 191 moves downward relative to the shaft 157, the sleeve 177, and the mill face 153. As the stem assembly 191 moves downward, the cam surfaces 233 are moved relative to the roller bearings 241 so that the roller bearings are brought into contact with the larger upper portion 235 of the cam surfaces. The roller bearings 241 are moved radially away from a centerline of the stabilizing means 159 and toward the internal wall of the casing or the uncased bore. The roller bearings 241 eventually are extended sufficiently past the outside periphery of the sleeve 177 to contact the internal wall of the casing or the uncased bore to stabilize the mill assembly 151 relative to the casing or the uncased bore.

When the flow of pressurized fluid is reduced to permit the spring 211 to expand, the stem assembly 191 is moved upward relative to the mill face 153, the sleeve 177, and the shaft 157. The roller bearings 241 are no longer pushed radially outward by the larger upper portions 235 of the cam surfaces 233 and can freely move between radially outermost positions in the seats 243 and radially innermost positions in contact with the narrow lower portions 237 of the cam surfaces. When the roller bearings 241 are no longer forced radially outward, it is possible to withdraw the stabilizing means 159 from the casing or the uncased bore without interference between the roller bearings and the internal wall of the casing or the uncased bore.

When a torque is applied to the shaft 157 in a known manner, it is transmitted to the sleeve 177 attached to the bottom end 163 of the shaft. The sleeve 177, in turn, transmits the torque to the mill face 153 attached at the bottom end 167 of the stabilizing means 159.

As with the mill assembly 21, the mill assembly 151 may be provided with cam followers of any desired type. Again, roller bearings 241 are preferred because of reduced frictional effects between the cam follower and the internal wall of the casing or the uncased bore.

A method of milling material in the casing 29 or in an uncased bore will now be described with reference to the mill assembly 21 shown in FIG. 1, except where otherwise noted. The mill face 23 at the end of the shaft assembly 25 is extended through the longitudinal opening 31 of the casing 29 into the casing or the uncased bore so that the mill face 23 contacts the material being milled. The shaft assembly 25 is stabilized relative to the internal wall 33 of the casing 29 or the uncased bore by applying a force to the shaft 35 so that the roller bearings 119 retained in the seats 121 on the sleeve 53 are moved relative to the cam surfaces 111 on the stem portion 89 of the mandrel 79 so that the roller bearings contact the larger diameter lower portions 115 of the cam surfaces, thereby causing the roller bearings to move radially outward from the centerline of the stabilizing means 37 and toward the internal wall 33 of the casing 29 or the uncased bore. The spring 105 resists movement of the sleeve 53 relative to the mandrel 79 and, when a downward force applied to the shaft assembly 25 is released, the spring expands to move the sleeve and the shaft 35 upward relative to the mandrel so that the roller bearings 119 are brought adjacent to the smaller diameter upper portions 113 of the cam surfaces 111 and are no longer forced radially outward past the periphery of the sleeve, thereby permitting axial movement of the sleeve relative to the internal wall 33 of the casing 29 or the uncased bore.

The method of milling with the mill assembly 151 shown in FIG. 2 is similar to the method described above with respect to the mill assembly 21 shown in FIG. 1. The cam surfaces 233 on the stem 195 of the stem assembly 191 are moved relative to the roller bearings 241 retained in the seats 243 in the sleeve 177 by applying a pressurized fluid against the top face 221 of the piston 201 so that the stem assembly compresses the spring 211 and moves relative to the mill face 153, the sleeve, and the shaft 157. In both the method of milling with the mill assembly 21 and the method of milling with the mill assembly 151, a torque is applied to the shaft 35 and 157, respectively, to turn the mill face 23 and 153, respectively, against the material being milled.

Although the present invention has been described in connection with a preferred embodiment thereof, it will be appreciated by those skilled in the art that additions, substitutions, and modifications not specifically described may be made without departing from the spirit and scope of the invention as defined in the appended claims.

What is claimed is:

1. A mill assembly for downhole milling in a bore, comprising:

a mill;

means, associated with the mill, for extending the mill into a bore; and means for stabilizing the extending means in the bore, including a cam, the cam having an exterior surface, the exterior portion including a shaped portion, a cam follower in contact with the shaped portion of the exterior surface of the cam, and one of the cam and the cam follower being axially movable in a first direction and relative to the other one of the cam and the cam follower, upon application of an axial force applied to the one of the cam and the cam follower in a first direction, so that the cam follower is moved radially outward from a centerline of the stabilizing means.

2. The mill assembly as set forth in claim 1, further comprising means for axially moving the one of the cam and the cam follower in a second direction so that the cam follower is movable radially inward toward the centerline.

3. The mill assembly as set forth in claim 2, wherein the axial moving means includes a spring for resisting movement of the one of the cam and the cam follower axially in the first direction.

4. The mill assembly as set forth in claim 1, wherein the stabilizing means includes means, fixed to the extending means, for retaining the cam follower within a range of radial movement relative to the cam.

5. The mill assembly as set forth in claim 4, wherein the retaining means is fixed to the mill.

6. The mill assembly as set forth in claim 5, wherein pressurized fluid directed against another portion of the exterior surface of the cam moves the cam relative to the cam follower axially in the first direction so that the cam follower moves radially outward.

7. The mill assembly as set forth in claim 4, wherein the mill is axially movable relative to the retaining means.

8. The mill assembly as set forth in claim 4, wherein the mill is fixed to the cam.

9. The mill assembly as set forth in claim 4, wherein the mill is axially movable in the first and second directions relative to the retaining means, the mill is fixed to the cam, and the axial force is applied through the extending means and the retaining means to move the cam follower relative to the cam axially in the first direction so that the cam follower moves radially outward.

10. The mill assembly as set forth in claim 9, wherein, after the cam follower is moved radially outward, the axial force applied to the extending means is transmitted to the cam and the mill.

11. The mill assembly as set forth in claim 4, wherein the retaining means includes a sleeve formed with a longitudinal bore in which the cam is axially movable in the first direction.

12. The mill assembly as set forth in claim 11, wherein the cam follower is a roller bearing and the sleeve is formed with a radial opening permitting at least partial extension of the roller bearing past an exterior periphery of the sleeve.

13. The mill assembly as set forth in claim 1, wherein a centerline of the mill and a centerline of the extending means are offset from one another.

14. A mill assembly as set forth in claim 1, wherein the bore includes a casing for lining interior walls of the bore.

15. A mill assembly for downhole milling in a bore, comprising:

a mill;

a shaft, associated with the mill, for extending the mill into a bore and into contact with a material to be milled; and means, connected at one end to the mill, for stabilizing the shaft in the bore, including a stem having one or more tapered surfaces, the tapered surfaces tapering from a first diameter to a second diameter larger than the first diameter, a plurality of roller bearings circumferentially retained around the stem, the roller bearings being in a common plane, each roller bearing being in contact with one of the tapered surfaces at a first point, and one of the plurality of roller bearings and the stem being axially movable in a first direction relative to the other one of plurality of roller bearings and the stem, upon application of an axial force to the one of the stem and the plurality of roller bearings, such that each of the plurality of roller bearings contacts the tapered surface at a second point closer to the second diameter than the first point and is thereby moved radially outward from a centerline of the stem.

16. The mill assembly as set forth in claim 15, wherein a centerline of the stabilizing means is offset from a centerline of the mill.

17. The mill assembly as set forth in claim 15, wherein the stabilizing means includes a sleeve disposed around and axially movable relative to the stem, the sleeve being provided with means for retaining the plurality of roller bearings, the retaining means including a plurality of circumferential openings provided in the sleeve, such that the roller bearings are adapted to be alternately partially extended past the periphery of the sleeve through the plurality of circumferential openings to an extended position and freely movable between the extended position and a retracted position.

18. The mill assembly as set forth in claim 17, wherein the retaining means includes a plurality of roller bearing seats in which the circumferential openings are formed, the seats being fastened to the sleeve around the circumference of the sleeve.

19. The mill assembly as set forth in claim 15, further comprising a spring that is compressed when the one of the plurality of roller bearings and the stem is moved axially in the first direction upon application of the axial force so that the roller bearings contact the tapered surface at the second point, the spring expanding, when the axial force is removed, so that the one of the the plurality of roller bearings and the stem is moved axially in a second direction and the plurality of roller bearings contacts the tapered surface at the first point.

20. The mill assembly as set forth in claim 19, wherein a through bore extends through the stabilizing means and the mill for supplying fluid to a surface being milled.

21. The mill assembly as set forth in claim 20, wherein the stem includes a choke portion, the choke portion forming a part of the through bore, for developing, as a result of hydraulic pressure of the supplied fluid, the force applied against the stem to compress the spring.

22. The mill assembly as set forth in claim 19, wherein the stabilizing means includes a sleeve disposed around and axially movable relative to the stem, the sleeve being provided with means for retaining the plurality of roller bearings, the retaining means including a plurality of circumferential openings provided in the sleeve, such that the roller bearings are adapted to be alternately partially extended past the periphery of the sleeve through the plurality of circumferential openings to an extended position, when the axial force is applied to the one of the stem and the plurality of roller bearings, and freely movable between the extended position and a retracted position, when the axial force is removed.

23. The mill assembly as set forth in claim 22, wherein the axial force is applied against and transmitted through the sleeve to compress the spring and to move the roller bearings relative to the stem.

24. The mill assembly as set forth in claim 23, wherein the force applied against the sleeve is transmitted to the sleeve from the shaft.

25. The mill assembly as set forth in claim 15, wherein a through bore extends through the stabilizing means and the mill for supplying fluid to a surface being milled.

26. A mill assembly as set forth in claim 15, wherein the bore includes a casing for lining interior walls of the bore.

27. A method of milling a material in a longitudinal opening having an inside diameter defined by an internal wall, with a mill at the end of a shaft, comprising the steps of:

extending the mill at the end of the shaft into the longitudinal opening and into contact with the material to be milled;

stabilizing the shaft relative to the internal wall of the longitudinal opening by axially moving one of a cam and a cam follower in a first direction, the cam and the cam follower forming a part of the shaft, relative to the other of the cam and the cam follower so that the cam follower is moved radially outward from a centerline of the shaft and toward the internal wall of the longitudinal opening.

28. The method of milling as set forth in claim 27, comprising the further step of axially moving one of the cam and the cam follower in a second direction so that the cam follower is movable radially inward from the internal wall of the longitudinal opening toward the centerline of the shaft to permit free axial movement of the shaft and the mill relative to the longitudinal opening.

29. The method of milling as set forth in claim 27, wherein the cam is axially moved relative to the cam follower by applying a pressurized fluid against a surface of the cam.

30. The method of milling as set forth in claim 27, wherein the cam follower is axially movable with the shaft, and the shaft and the cam follower are moved relative to the cam by an axial force applied to the shaft.

31. The method of milling as set forth in claim 27, comprising the further step of applying a torque to the shaft to turn the mill against the material being milled.

* * * * *